US006248045B1

(12) United States Patent
Stearns et al.

(10) Patent No.: US 6,248,045 B1
(45) **Date of Patent: *Jun. 19, 2001**

(54) EXERCISE METHOD AND APPARATUS

(76) Inventors: Kenneth W. Stearns, 8009 Cedel, Houston, TX (US) 77055; Joseph D. Maresh, 19919 White Cloud Cir., West Linn, OR (US) 97068

( * ) Notice: Subject to any disclaimer, the term of this patent is extended or adjusted under 35 U.S.C. 154(b) by 0 days.

This patent is subject to a terminal disclaimer.

(21) Appl. No.: 09/510,030

(22) Filed: Feb. 22, 2000

Related U.S. Application Data

(63) Continuation of application No. 08/946,460, filed on Oct. 7, 1997, now Pat. No. 6,027,403.

(60) Provisional application No. 60/042,257, filed on Mar. 31, 1997, and provisional application No. 60/044,959, filed on Apr. 26, 1997.

(51) Int. Cl.[7] ..... A63B 22/00

(52) U.S. Cl. ..... 482/52; 482/57; 482/51

(58) Field of Search ..... 482/51, 52, 53, 482/57, 70, 79, 80, 148

(56) References Cited

U.S. PATENT DOCUMENTS

| | | | | |
|---|---|---|---|---|
| 4,185,622 | | 1/1980 | Swenson | 128/25 B |
| 4,786,050 | | 11/1988 | Geschwender | 272/73 |
| 5,242,343 | | 9/1993 | Miller | 482/57 |
| 5,518,473 | | 5/1996 | Miller | 482/57 |
| 5,540,637 | | 7/1996 | Rodgers, Jr. | 482/52 |
| 5,562,574 | | 10/1996 | Miller | 482/51 |
| 5,577,985 | | 11/1996 | Miller | 482/52 |
| 5,593,372 | | 1/1997 | Rodgers, Jr. | 482/52 |
| 5,692,994 | | 12/1997 | Eschenbach | 482/51 |
| 5,707,321 | | 1/1998 | Maresh | 482/57 |
| 5,792,026 | | 8/1998 | Maresh et al. | 482/57 |
| 6,027,430 | * | 6/2000 | Stearns et al. | 482/51 |
| 6,080,086 | * | 6/2000 | Maresh et al. | 482/57 |

* cited by examiner

*Primary Examiner*—Stephen R. Crow

(57) ABSTRACT

An exercise apparatus links rotational motion and/or reciprocal pivoting motion to elliptical travel of a force receiving member. In one embodiment, a first link is pivotally mounted on a frame; a crank is rotatably mounted on the frame; a second link is rotatably connected to the crank; the force receiving member is rotatably interconnected between the first link and the second link; and a connector is rotatably interconnected between the first link and the second link. In another embodiment, the first link is pivotally mounted on a post which in turn, is pivotally mounted on a frame.

10 Claims, 9 Drawing Sheets

EXERCISE METHOD AND APPARATUS

CROSS-REFERENCE TO RELATED APPLICATION

This application is a continuation of U.S. patent application Ser. No. 08/946,460, filed on Oct. 7, 1997 (now U.S. Pat. No. 6,027,340), which is incorporated herein by reference, and which, in turn discloses subject matter entitled to the earlier filing dates of provisional application Ser. No. 60/042,257, filed on Mar. 31, 1997, and provisional application Ser. No. 60/044,959, filed on Apr. 26, 1997.

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical.

Exercise equipment has also been designed to facilitate full body exercise. For example, reciprocating cables or pivoting arm poles have been used on many of the equipment types discussed in the preceding paragraph to facilitate contemporaneous upper body and lower body exercise.

SUMMARY OF THE INVENTION

In one respect, the present invention may be seen to provide a novel linkage assembly and corresponding exercise apparatus suitable for linking circular motion to relatively more complex, generally elliptical motion. In particular, a first link is rotatably interconnected between a frame and a foot support (or other force receiving member); a crank is rotatably mounted on the frame; a second link is rotatably interconnected between the crank and the foot support; and an intermediate link is rotatably interconnected between the first link and the second link. As the crank rotates, the linkage assembly constrains the foot support to travel through a generally elliptical path.

In another respect, the present invention may be seen to provide a novel linkage assembly and corresponding exercise apparatus suitable for linking reciprocal motion to relatively more complex, generally elliptical motion. In particular, as the foot support moves through its generally elliptical path, the linkage assembly constrains the first link to pivot back and forth. A portion of the first link may be sized and configured for grasping by a person standing on the foot support.

In yet another respect, the present invention may be seen to provide a novel linkage assembly and corresponding exercise apparatus suitable for incremental adjustments to the size and/or shape of the path of motion. In particular, the intermediate link may be selectively connected to the second link at any of a plurality of positions to alter the path of exercise motion.

In still another respect, the present invention may be seen to provide a novel linkage assembly and corresponding exercise apparatus suitable for adjusting the configuration of the elliptical path of motion during exercise. In one embodiment, for example, a post is pivotally mounted on the base of the frame, and the first link is rotatably connected to the post. By applying more than a threshold quantity of force against the post, a person may reposition the pivot axis of the first link while the foot support is moving. Many advantages and improvements of the present invention may become apparent from the more detailed description that follows.

BRIEF DESCRIPTION OF THE DRAWING

With reference to the Figures of the Drawing, wherein like numerals represent like parts and assemblies throughout the several views.

DESCRIPTION OF THE DEPICTED EMBODIMENT

Figure 1:
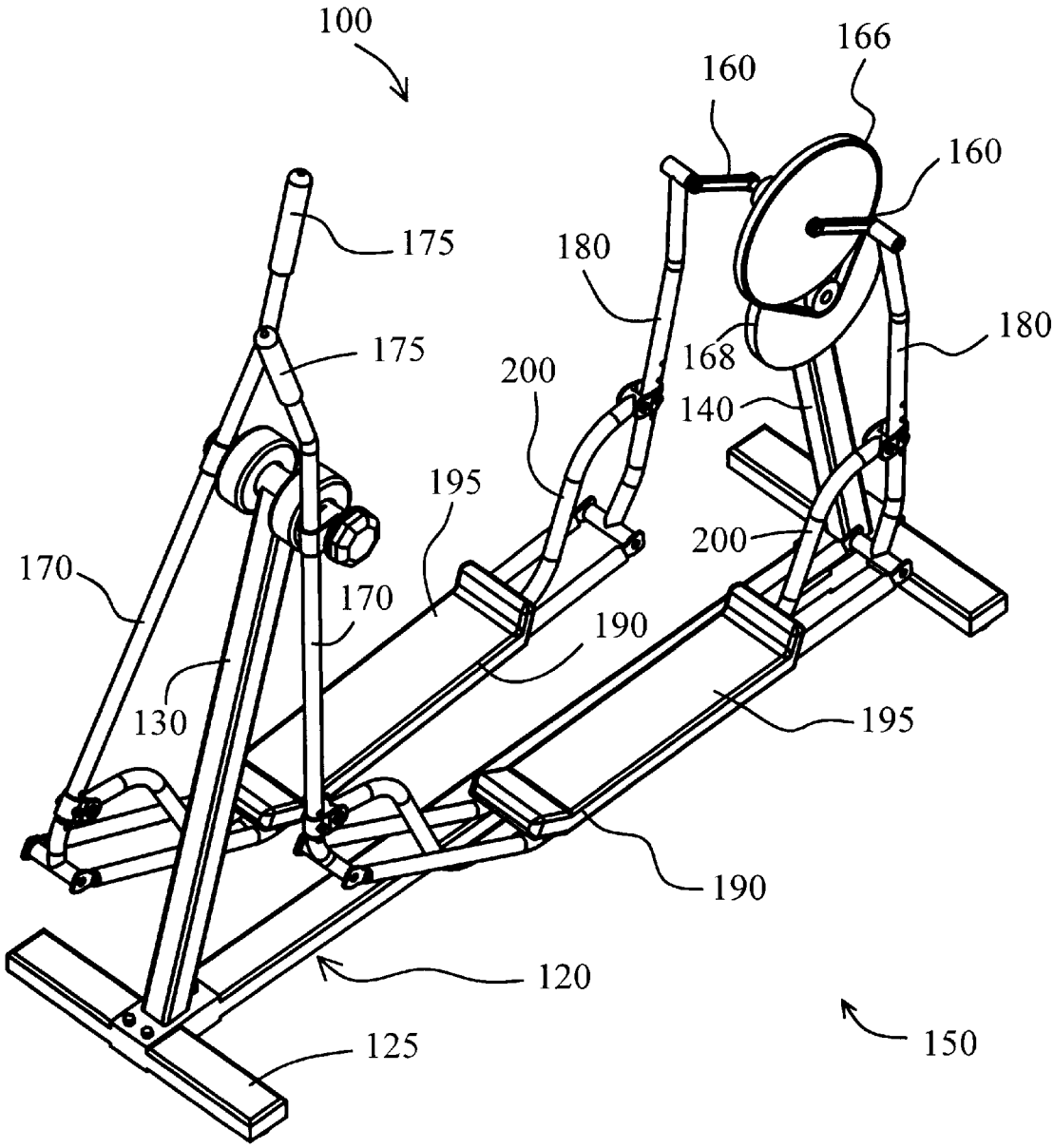
FIG. 1 is a perspective view of an exercise apparatus constructed according to the principles of the present invention.
Figure 2:
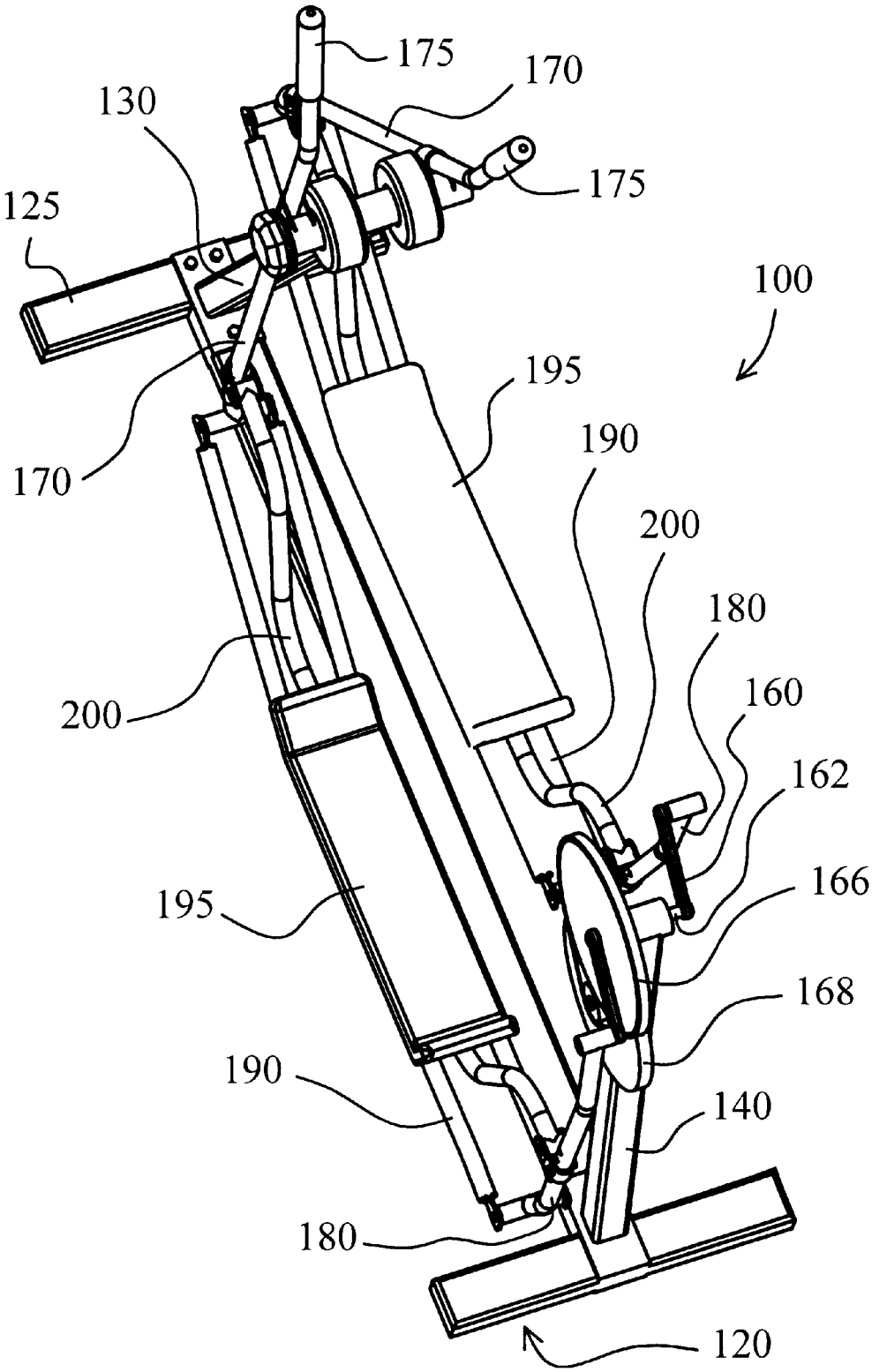
FIG. 2 is another perspective view of the exercise apparatus of FIG. 1.
Figure 3:
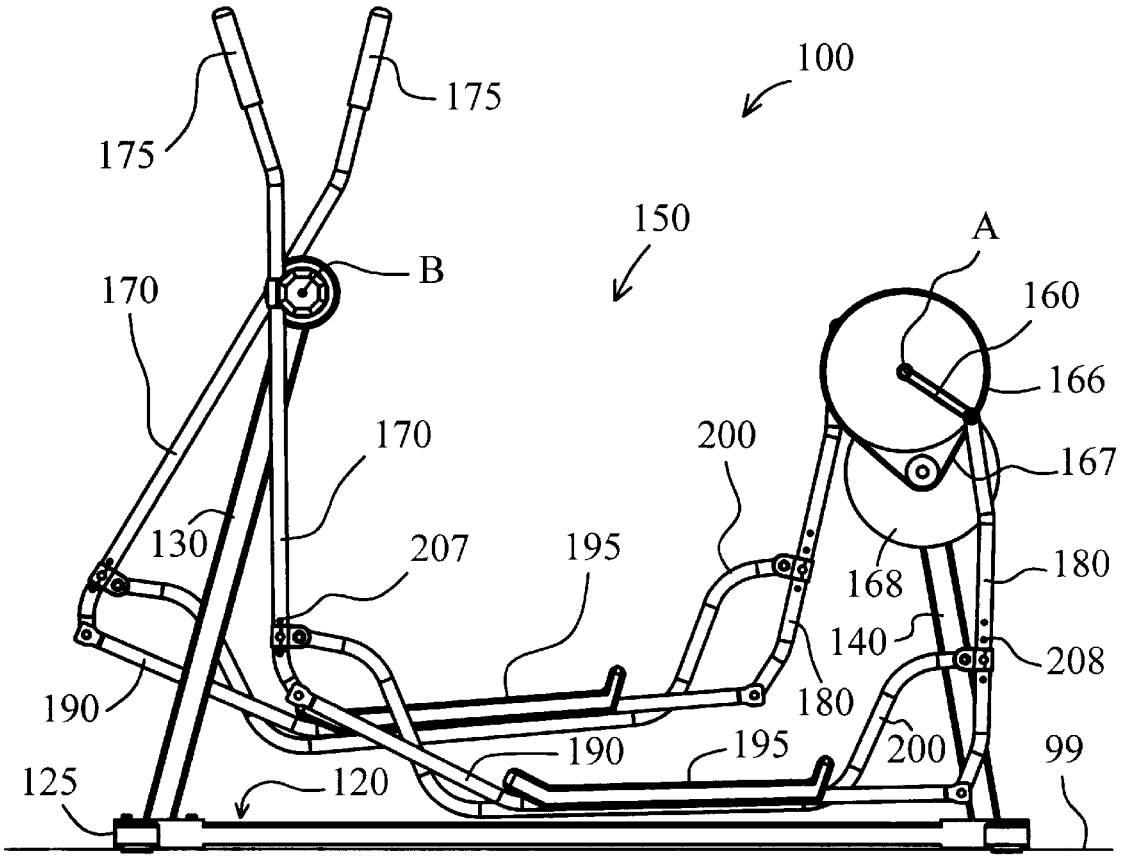
FIG. 3 is a side view of the exercise apparatus of FIG. 1.
Figure 4:
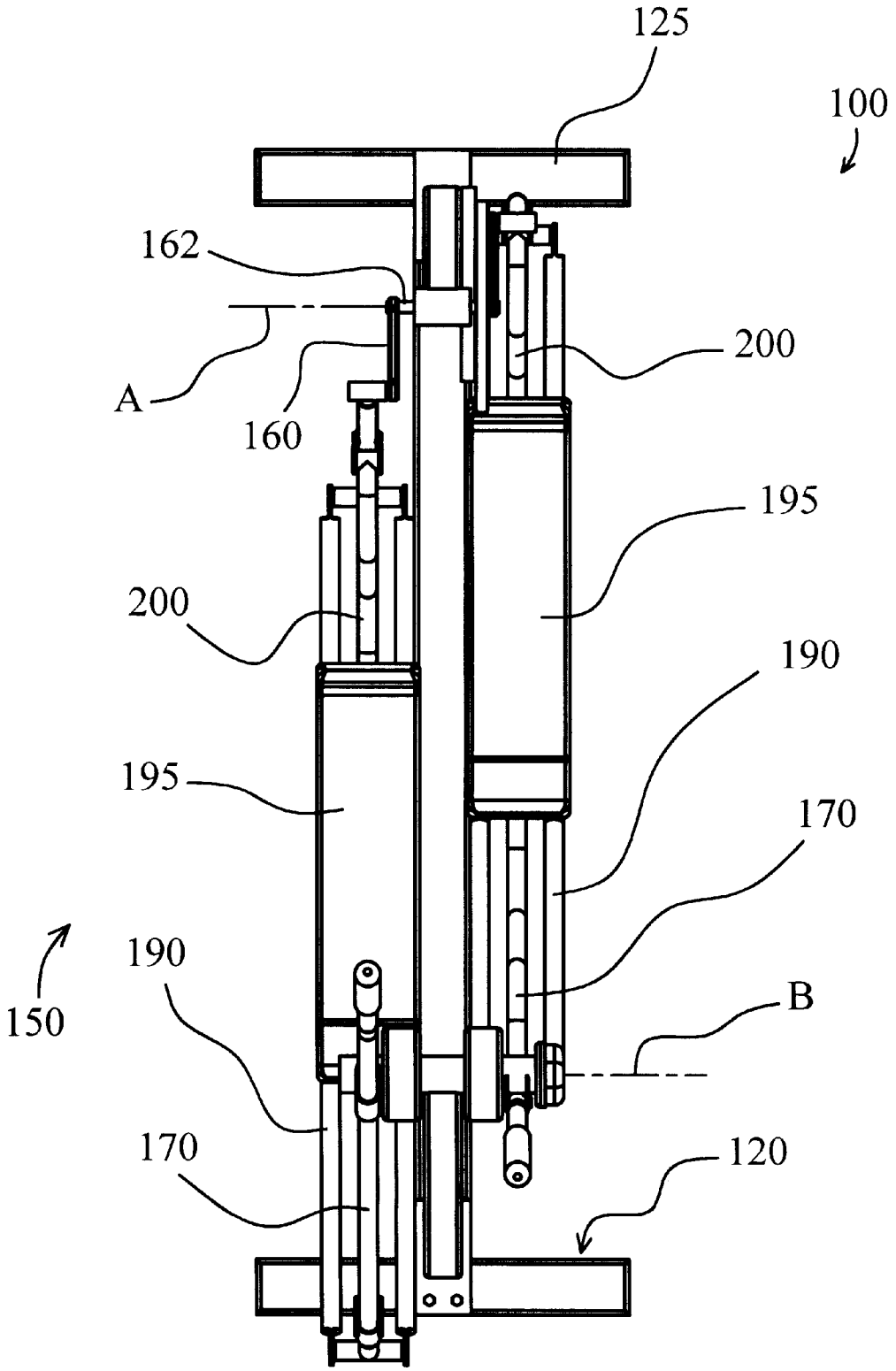
FIG. 4 is a top view of the exercise apparatus of FIG. 1.
Figure 5:
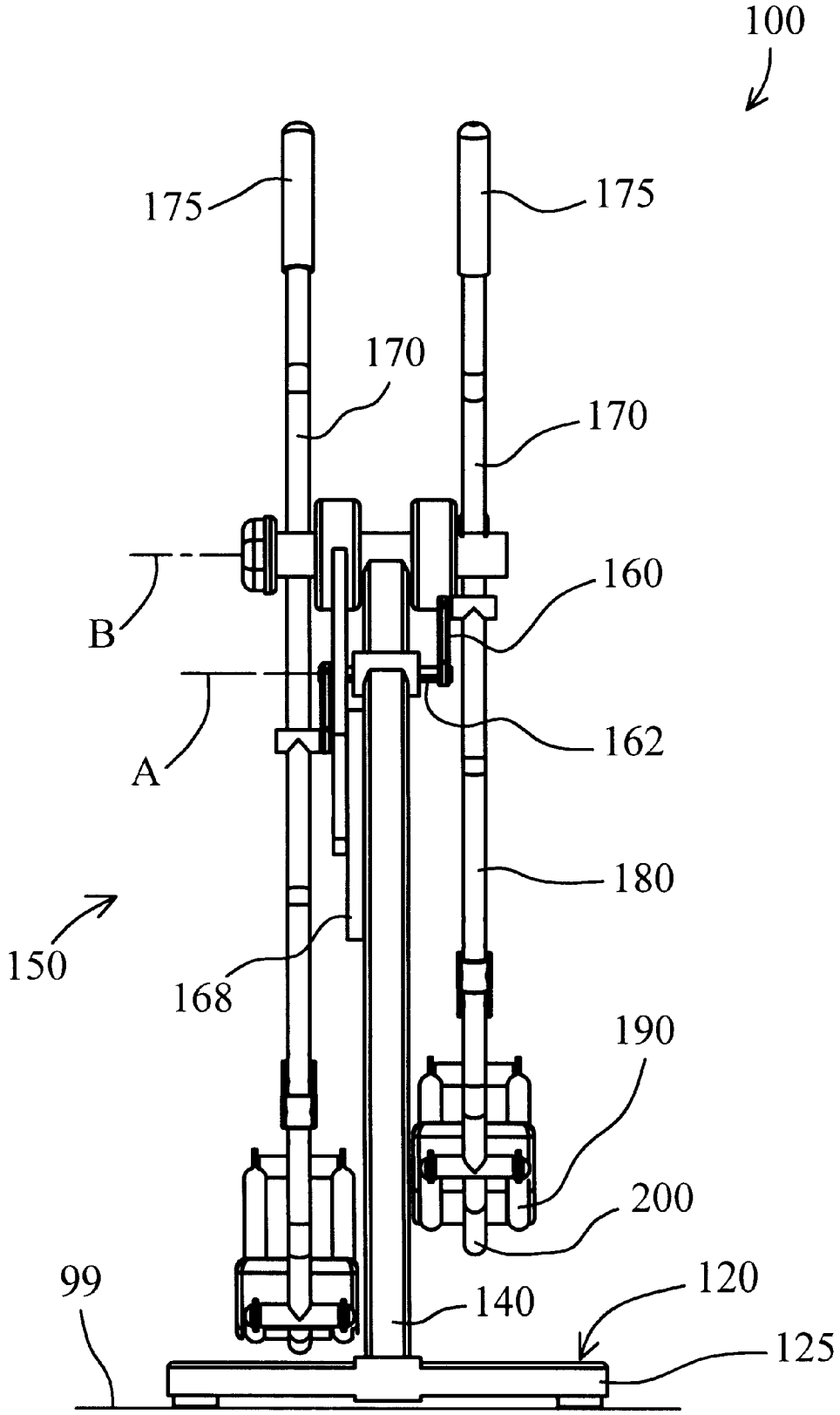
FIG. 5 is a rear end view of the exercise apparatus of FIG. 1.

A first exercise apparatus constructed according to the principles of the present invention is designated as 100 in FIGS. 1–5. The apparatus 100 generally includes a frame 120 and a linkage assembly 150 movably mounted on the frame 120. Generally speaking, the linkage assembly 150 moves relative to the frame 120 in a manner that links rotation of a crank 160 to generally elliptical motion of a force receiving member 190. The term "elliptical motion" is intended in a broad sense to describe a closed path of motion having a relatively longer first axis and a relatively shorter second axis (which extends perpendicular to the first axis).

The frame 120 includes a generally I-shaped base 125 designed to rest upon a floor surface 99; a forward stanchion 130, which extends upward from a forward end of the base 125; and a rearward stanchion 140, which extends upward from an opposite, rearward end of the base 125. The apparatus 100 is generally symmetrical about a vertical plane extending lengthwise through the base 125 (perpendicular to the transverse members at each end thereof), the only exceptions being the relative orientation of certain parts of the linkage assembly 150 on opposite sides of the plane of symmetry; and some parts associated with the crank 160. Those skilled in the art will also recognize that the portions of the frame 120 which are intersected by the plane of symmetry exist individually and thus, do not have any "opposite side" counterparts. Moreover, to the extent that reference is made to forward or rearward portions of the apparatus 100, it is to be understood that a person could exercise while facing in either direction relative to the linkage assembly 150.

The linkage assembly 150 generally includes left and right cranks 160, left and right forward or first links 170, left and right rearward or second links 180, left and right force receiving or third links 190, and left and right intermediate or fourth links 200. On the embodiment 100, the cranks 160 and the links 170, 180, 190, and 200 on the left side of the apparatus 100 are 180 degrees out of phase with their counterparts on the right side of the apparatus 100. However, like reference numerals are used to designate both the "right-hand" and "left-hand" parts on the apparatus 100, and in general, when reference is made to one or more parts on only one side of the apparatus, it is to be understood that corresponding part(s) are disposed on the opposite side of the apparatus 100.

On each side of the apparatus 100, a crank 160 is rotatably mounted on the rear stanchion 140 via a common shaft. In particular, the rearward stanchion 140 supports a bearing assembly; an axle 162 is inserted through a laterally extending hole in the bearing assembly; and a crank 160 is keyed to each of the protruding ends of the axle 162, on opposite sides of the stanchion 140. These rotating members 160 rotate about a common axis designated as A (see FIGS. 3–5). A pulley 166 is also secured to the axle 162 and rotates together with the cranks 160. A flywheel 168 is rotatably mounted on the rearward stanchion 140 in a manner known in the art, and a belt 167 links rotation of the pulley 166 to rotation of the flywheel 168. In particular, the belt 167 is trained about the outermost circumference of the pulley 166 and about a relatively smaller hub on the flywheel 168 to provide a "stepped up" flywheel arrangement or resistance device which tends to resist changes in crank speed.

On each side of the apparatus 100, the forward link 170 has an intermediate portion rotatably connected to the forward stanchion 130 and a lower end rotatably connected to a forward end of the force receiving member 190. An opposite, upper end of the forward link 170 is sized and configured (see handle 175) for grasping by a person standing on the force receiving member 190. An opposite, rearward end of the force receiving member 190 is rotatably connected to a lower end of the rearward link 180. An opposite, upper end of the rearward link 180 is rotatably connected to the crank 160. A forward end of the fourth link 200 is rotatably connected to the forward link 170, beneath the pivot axis B and proximate the lower end of the link 170. An opposite, rearward end of the fourth link 200 is rotatably connected to an intermediate portion of the rearward link 180.

The force receiving member 190 supports a platform 195 sized and configured to support a person's foot. The fourth link 200 is configured in the manner shown (routed beneath the foot platform 195) to avoid interfering with a person's leg during operation of the apparatus 100. Rotation of the cranks 160 relative to the frame 120 causes the foot platforms 195 to move through a generally elliptical path of motion and the handles 175 to pivot back and forth. In other words, the handles 175 may be said to be second, discrete force receiving members which travel through reciprocal paths of motion as the foot supports 195 travel through generally elliptical paths of motion. Those skilled in the art will also recognize that the handles 175 could be secured directly to the frame 120 and either move relative thereto or be fixed in place, for example, to provide different forms of arm exercise and/or support.

The points of connection between the fourth link 200 and the forward and/or rearward links 170 and 180 may be adjusted to alter the size and/or configuration of the path of motion travelled by the force receiving member 190. In particular, at least one hole extends through each end of the fourth link 200, and a series of holes 207 extend through the forward link 170, and another series of holes 208 extend through the rearward link 180. Fasteners are inserted through the holes in the fourth link 200 and any one of the holes 207 and 208 to rotatably interconnect the fourth link 200 between the two links 170 and 180. Adjustments to the location of the rearward connection result in relatively more dramatic changes to the path of motion. The foot stroke is increased by lowering the point of connection along the rearward link 180.

Those skilled in the art will also recognize that each of the components of the linkage assembly 150 is sized and configured to facilitate the depicted interconnections in a relatively efficient manner. For example, the members 190 and 200 need only be long enough to extend between and interconnect the first link 170 and the second link 180. Furthermore, for ease of reference in both this detailed description and the claims set forth below, the components are sometimes described with reference to "ends" being connected to other parts. For example, the fourth link 200 may be said to have a first end rotatably connected to the first link 170 and a second end rotatably connected to the second link 180. However, those skilled in the art will recognize that the present invention is not limited to links which terminate immediately beyond their points of connection with or extend directly between other parts. In other words, the term "end" should be interpreted broadly, in a manner that could include "rearward portion", for example; and in a manner wherein "rear end" could simply mean "behind an intermediate portion", for example. Moreover, the links need not extend directly between their points of connection with other parts, as demonstrated by the fourth links 200, for example.

Figure 6:
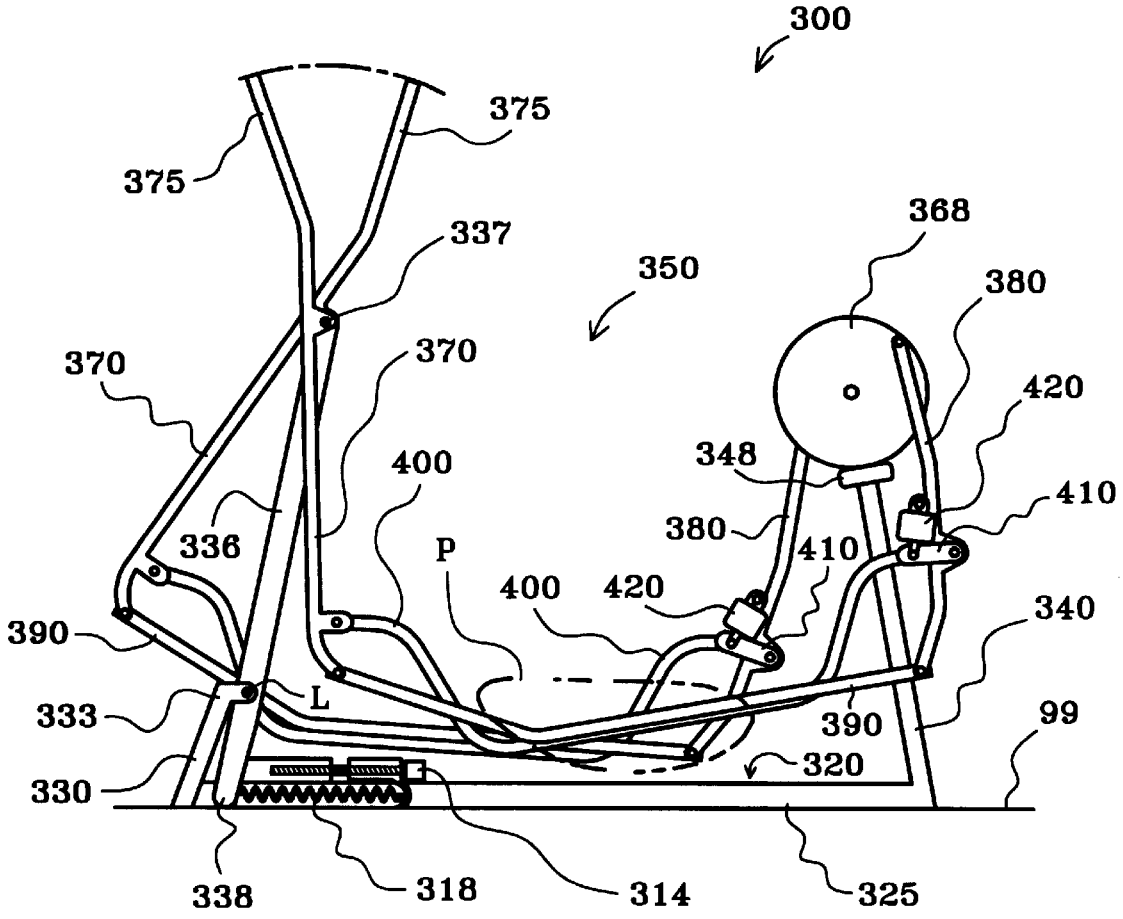
FIG. 6 is a side view of another exercise apparatus constructed according to the principles of the present invention, showing a first orientation of linkage assembly components.
Figure 7:
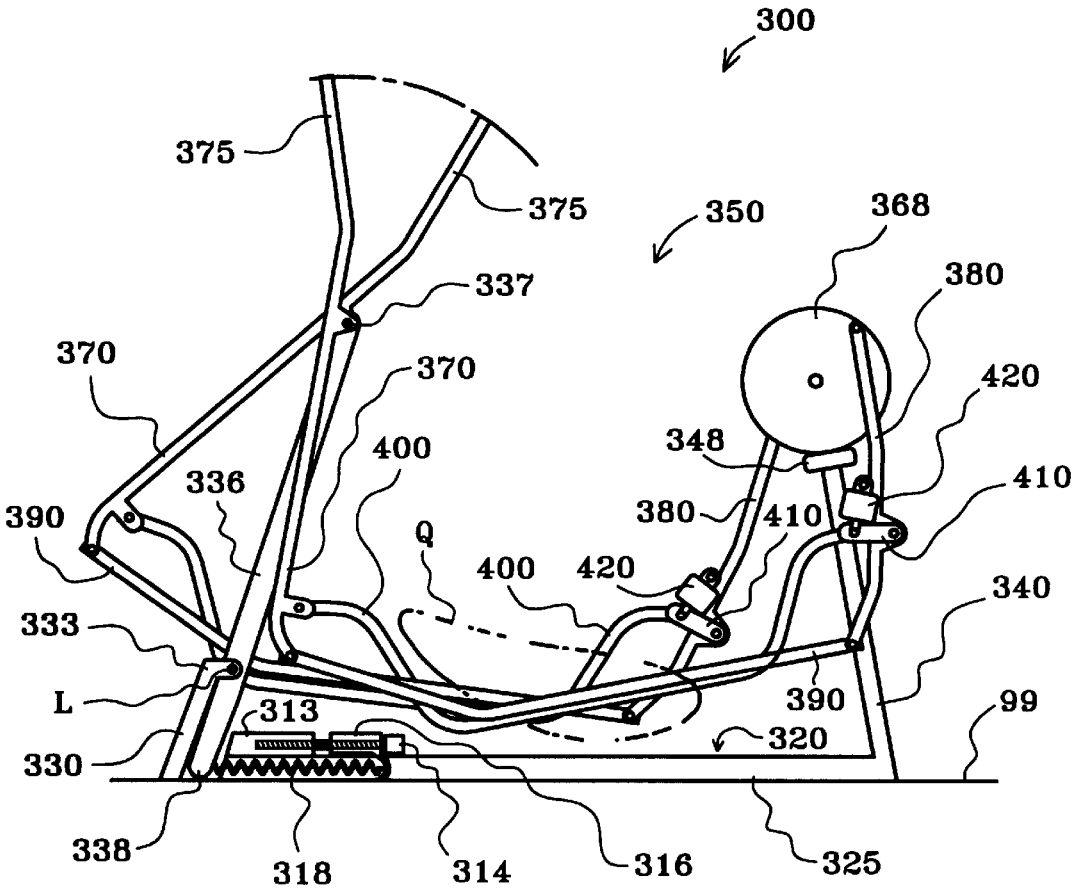
FIG. 7 is a side view of the exercise apparatus of FIG. 6, showing a second orientation of linkage assembly components.

Another embodiment of the present invention is designated as 300 in FIGS. 6–7. The exercise apparatus 300 is similar in some respects to the embodiment 100 discussed above, and when similarly configured, the two apparatus 100 and 300 generate a similar elliptical path of motion, which is designated as P in FIG. 6. However, those skilled in the art will also recognize that the exercise apparatus 300 is distinct in certain respects.

Like the first embodiment 100, the apparatus 300 includes a linkage assembly 350 movably mounted on a frame 320. The frame 320 generally includes a base 325 designed to rest upon a floor surface 99; a forward stanchion 330, which extends upward from a forward end of the base 325; and a rearward stanchion 340, which extends upward from an opposite, rearward end of the base 325. Unlike the first embodiment 100, two flywheels 368 are rotatably mounted on opposite sides of the rearward stanchion 340, and rearward links 380 are rotatably connected directly to respective flywheels 368 (at radially displaced positions relative to the flywheel axis). As a result, the flywheels 368 may also be described as cranks.

The forward stanchion 330 is significantly shorter than that on the first embodiment 100. A trunnion 333 is provided on the forward stanchion 330, and a post 336 is rotatably mounted on the trunnion 333. The post 336 is comparable in length to the forward stanchion 130 on the first embodiment 100. The post 336 is pivotal about a pivot axis L relative to the base 325. Forward links 370 are rotatably connected to the post 336 proximate its upper end 337. As a result of this arrangement, a person may selectively vary the elliptical path of motion "on the fly" by moving the post 336 about the pivot axis L relative to the base 325 during exercise. A second possible path for the force receiving members 390 is designated as Q in FIG. 7. Those skilled in the art will recognize that, if desired, the post 336 could be selectively locked against pivoting simply by securing a rigid fastener between overlapping portions of the lower end 338 and the base 325.

An opposite, lower end 338 of the post 336 is disposed beneath the pivot axis L. The forward stanchion 330 lies within the arcuate path traveled by the lower end 338 and provides a limit to forward pivoting of the lower end 338. A fixed block 313 is secured to the base 325 rearward of the lower end 338 and within the arcuate path of the lower end 338. Thus, the fixed block 313 provides a limit to rearward pivoting of the lower end 338. Those skilled in the art will recognize that either or both of the pivot limits could be relocated in any number of ways to adjust the available range of pivoting. For example, either pivot limit could be slidably mounted to the base 325 and secured in place by inserting one or more fasteners through aligned holes in the pivot stop and the base 325.

A spring 318 is disposed between the lower end 338 and a sliding block 316. The spring 318 functions to bias the lower end 338 toward the forward stanchion 330, thereby reducing the amount of force required to pivot the lower end 338 forward. The sliding block 316 is movably secured to the fixed block 313 and the base 325 by means of a lead screw 314 which inserts through the sliding block 316 and threads into the fixed block 313. Rotation of the lead screw 314 in a first direction causes the sliding block 316 to move toward the fixed block 313, increasing compression in the spring 318. Rotation of the lead screw in a second, opposite direction causes the sliding block 316 to move away from the fixed block 313, decreasing compression in the spring 318.

The force receiving members 390 are rotatably interconnected between lower ends of respective forward links 370 and respective rearward links 380. Upper ends 375 of the forward links 370 are sized and configured for grasping by a person standing on the force receiving members 390. Intermediate connectors or fourth links 400 are also rotatably interconnected between respective forward links 370 and respective rearward links 380.

The intermediate links 400 are adjustable relative to the rearward links 380 to alter the path of motion traveled by the force receiving members 390. In particular, on each side of the apparatus 300, a fifth link 410 is rotatably interconnected between the intermediate link 400 and the rearward link 380; and an adjustable length member 420 is rotatably interconnected between the fifth link 410 and the rearward link 380. In this particular embodiment, the adjustable length member 420 includes a threaded shaft which is connected to the fifth link 410; a tube which is connected to the rearward link 380; and a knob which is rotatably mounted relative to the tube and threaded onto the shaft. Rotation of the knob in a first direction causes the shaft to move away from the tube, thereby lowering the effective pivot axis of the force receiving member 390 relative to the rearward link 380. Rotation of the knob in a second, opposite direction causes the shaft to move toward the tube, thereby raising the effective pivot axis of the force receiving member 390 relative to the rearward link 380. Those skilled in the art will recognize that a spring and/or a damper could be substituted for the adjustable length member 420 to provide a relatively less constrained exercise motion. Those skilled in the art will also recognize that a semi-rigid member may be substituted for the adjustable length member 420 or for both the adjustable length member 420 and the fifth link 410, so that a force in excess of a threshold force would stretch the semi-rigid member and result in an "on the fly" change in the foot path.

Figure 8:
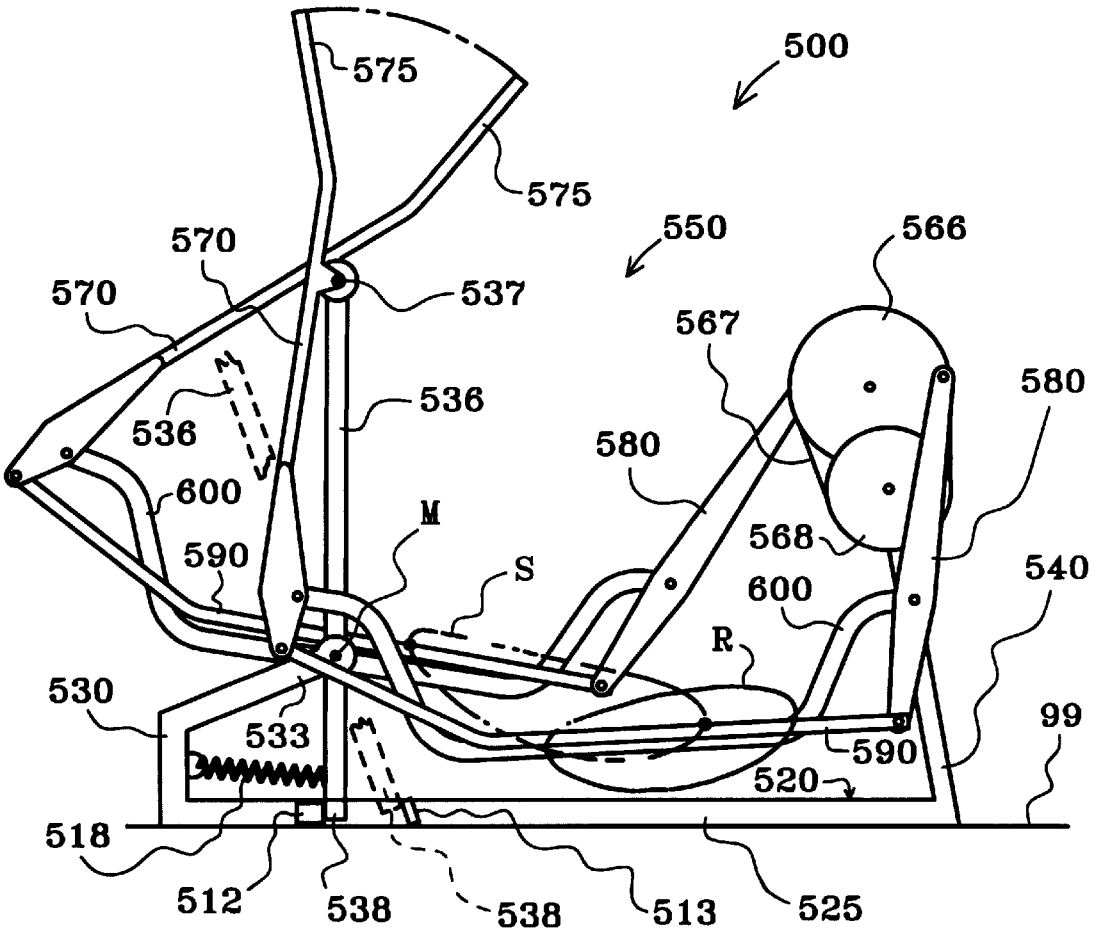
FIG. 8 is a side view of yet another exercise apparatus constructed according to the principles of the present invention.

Yet another embodiment of the present invention is designated as 500 in FIG. 8. The exercise apparatus 500 is similar in many respects to the previous embodiment 300. The apparatus 500 includes a linkage assembly 550 movably mounted on a frame 520. The frame 520 generally includes a base 525 designed to rest upon a floor surface 99; a forward stanchion 530, which extends upward from a forward end of the base 525; and a rearward stanchion 540, which extends upward from an opposite, rearward end of the base 525. A pulley 566 and a flywheel 568 are rotatably mounted on the rearward stanchion 540 and interconnected by a belt 567, and rearward links 580 are rotatably connected directly to the pulley 566 (at radially displaced positions relative to the pulley axis).

The forward stanchion 530 is similar to that of the previous embodiment 300. In particular, a trunnion 533 is provided on the forward stanchion 530, and a post 536 is rotatably mounted on to the trunnion 533. The post 536 pivots about a pivot axis M relative to the base 525. Forward links 570 are rotatably connected to the post 536 proximate its upper end 537. As a result of this arrangement, a person may selectively vary the elliptical path of motion "on the fly" by moving the pivot axis M relative to the base 525 during exercise. For example, when the post 536 occupies the "solid line" orientation shown in FIG. 8, the force receiving members 590 move through the path designated as S, and when the post 536 occupies the "dashed line" orientation shown in FIG. 8, the force receiving members 590 move through the path designated as R. Those skilled in the art will recognize that, if desired, the post 536 could be selectively locked against pivoting simply by securing a rigid fastener between overlapping portions of the lower end 538 and the base 525.

An opposite, lower end 538 of the post 536 is disposed beneath the pivot axis M. A forward stop 512 is secured to the base 525 to prevent the lower end 538 from pivoting forward beyond a vertical orientation. A rearward stop 513 is secured to the base 525 to limit rearward pivoting of the lower end 538. Those skilled in the art will recognize that either or both of the pivot stops could be relocated in any number of ways to adjust the permissible range of pivoting. For example, either pivot stop could be slidably mounted to the base 525 and secured in place by inserting one or more fasteners through aligned holes in the pivot stop and the base 525.

A spring 518 is disposed between the lower end 538 and the forward stanchion 530. The spring 518 functions to bias the lower end 538 toward the forward stanchion 530, thereby reducing the amount of force required to pivot the lower end 538 forward. Those skilled in the art will recognize that an adjustment mechanism could be provided to selectively adjust the bias of the spring 518.

The force receiving members 590 are rotatably interconnected between lower ends of respective forward links 570 and lower ends of respective rearward links 580. Upper ends 575 of the forward links 570 are sized and configured for grasping by a person standing on the force receiving members 590. Intermediate connectors or fourth links 600 are also rotatably interconnected between respective forward links 570 and respective rearward links 580. Again, those skilled in the art will recognize that an adjustment mechanism could be provided to selectively adjust the orientation of the fourth links 600 relative to the rearward links 580.

Figure 9:
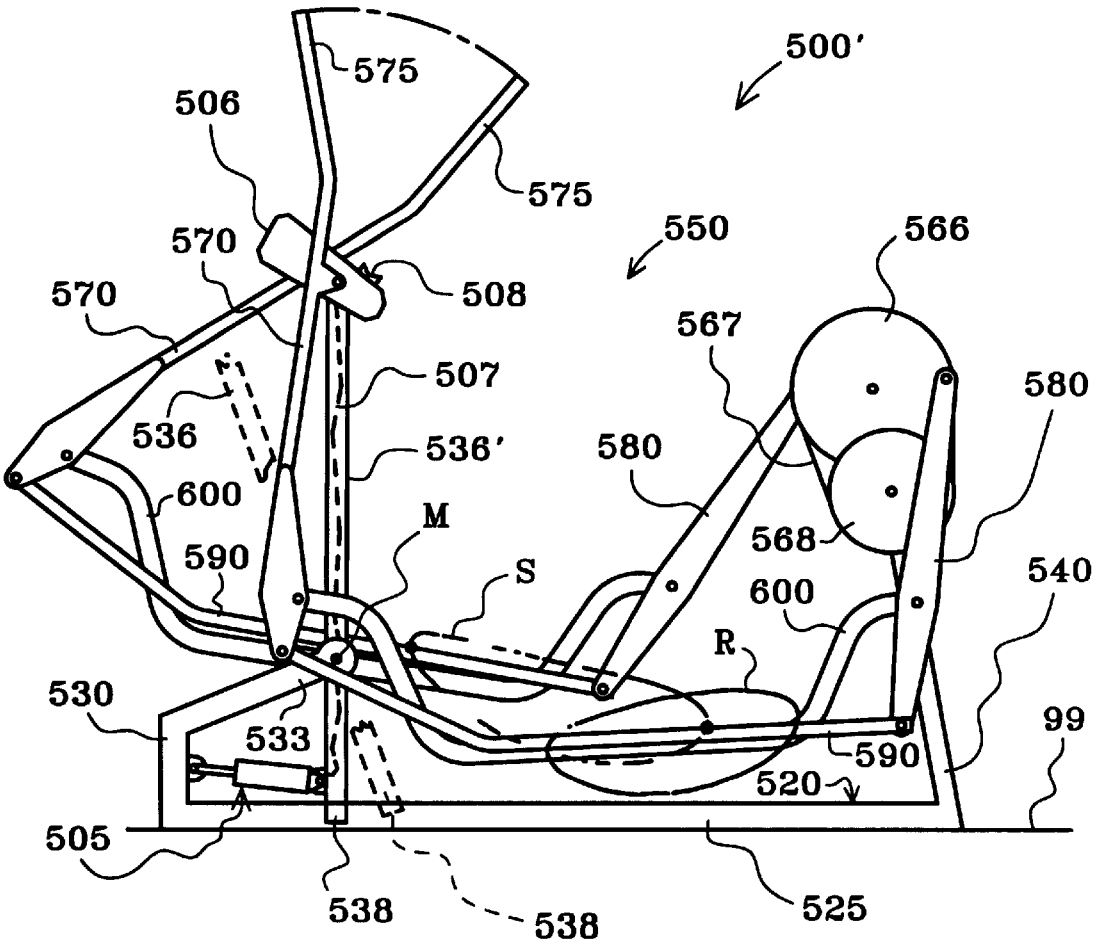
FIG. 9 is a side view of still another exercise apparatus constructed according to the principles of the present invention.

Those skilled in the art will also recognize that the force responsive adjustment system shown in FIG. 8 could be replaced by a controlled adjustment system such as that shown in FIG. 9. As suggested by the common reference numerals, the apparatus 500' is similar in many respects to the apparatus 500. However, the spring 518 and the stops 512 and 513 have been replaced by a linear actuator 505 which is rotatably interconnected between the forward stanchion 530 and the lower end 538 of the post 536. The actuator is connected to a controller 506 by means of a wire 507 routed through the post 536' and is operated by means of a toggle button 508. The actuator 505 maintains the lower end 538 of the post 536 at a fixed distance from the forward stanchion 530 until receiving a signal from the controller 506. The actuator may be seen to provide a means for programming changes in the foot path and/or allowing a user to make selected changes in the foot path.

Those skilled in the art will recognize more embodiments, modifications, and/or applications which differ from those described herein yet nonetheless fall within the scope of the present invention. Among other things, a variety of exercise options may be provided wherein a user can vary the path of exercise "on the fly" by exerting a force, either forward or rearward, through the arms and/or legs. Such adjustability may be provided in the form of links which are selectively movable relative to one another and/or the frame, and/or in the form of links which are selectively deformable in response to a force in excess of a threshold force. Moreover, other types of inertia altering and/or resistance devices, such as a band brake or a motor, could be added to or substituted for the flywheel arrangement without departing from the scope of the present invention. Furthermore, the size, configuration, and/or arrangement of the components of the preferred embodiment may be modified as a matter of design choice. Recognizing that the foregoing description sets forth only some of the numerous possible modifications and variations, the scope of the present invention is to be limited only to the extent of the claims which follow.

What is claimed is:

1. A method of facilitating generally elliptical movement of left and right foot platforms, comprising the steps of:

providing a base designed to rest upon a floor surface;

mounting a drive assembly on a first end of the base;

mounting left and right rocker links on an opposite, second end of the base, such that the rocker links pivot about a common pivot axis relative to the base;

interconnecting left and right foot supporting links between the drive assembly and respective rocker links;

mounting the left and right foot platforms on the left and right foot supporting links, respectively; and interconnecting left and right drawbar links between the drive assembly and respective rocker links, such that the drawbar links pivot at a first radius from the pivot axis, and the foot supporting links pivot at a second, relatively greater pivot radius from the pivot axis.

2. The method of claim 1, further comprising the step of configuring upper distal ends of the rocker links for grasping by a person standing on the foot platforms.

3. The method of claim 1, further comprising the step of selecting adjusting at least one of the first radius and the second radius.

4. The method of claim 1, wherein the mounting of the drive assembly involves mounting left and right cranks on the base, such that the cranks rotate about a common crank axis relative to the base.

5. The method of claim 4, wherein the drawbar links pivot about respective first pivot axes relative to the drive assembly, and the foot supporting links pivot about respective second pivot axes relative to the drive assembly.

6. The method of claim 5, wherein the second pivot axes are spaced further from the crank axis than the first pivot axes are.

7. The method of claim 6, wherein each of the drawbar links is configured to have an intermediate portion which extends beneath a respective foot platform.

8. The method of claim 5, further comprising the step of selecting adjusting at least one of the first pivot axes and the second pivot axes relative to the crank axis.

9. The method of claim 1, wherein each of the drawbar links is configured to have an intermediate portion which extends beneath a respective foot platform.

10. The method of claim 4, wherein the mounting of the drive assembly further involves mounting left and right support links on respective cranks, and the drawbar links and the foot supporting links are pivotally connected to respective support links.

* * * * *